US012221725B2

(12) United States Patent
Yokoyama et al.

(10) Patent No.: US 12,221,725 B2
(45) Date of Patent: Feb. 11, 2025

(54) METHOD FOR PRODUCING CARBON FIBER BUNDLE

(71) Applicants: TEIJIN LIMITED, Osaka (JP); WACKER CHEMIE AG, Munich (DE)

(72) Inventors: Hiroko Yokoyama, Osaka (JP); Eiji Kinoshita, Osaka (JP); Satoshi Ohno, Chikusei (JP); Izuru Taketa, Chikusei (JP)

(73) Assignees: TEIJIN LIMITED, Osaka (JP); WACKER CHEMIE AG, Munich (DE)

( * ) Notice: Subject to any disclaimer, the term of this patent is extended or adjusted under 35 U.S.C. 154(b) by 529 days.

(21) Appl. No.: 17/638,560

(22) PCT Filed: Aug. 27, 2020

(86) PCT No.: PCT/JP2020/032321
§ 371 (c)(1),
(2) Date: Feb. 25, 2022

(87) PCT Pub. No.: WO2021/039891
PCT Pub. Date: Mar. 4, 2021

(65) Prior Publication Data

US 2022/0290337 A1 Sep. 15, 2022

(30) Foreign Application Priority Data

Aug. 30, 2019 (JP) ..... 2019-159139

(51) Int. Cl.
*D01F 9/22* (2006.01)
*D06M 15/643* (2006.01)

(52) U.S. Cl.
CPC ..... *D01F 9/225* (2013.01); *D06M 15/643* (2013.01)

(58) Field of Classification Search
CPC ... D01F 9/225; D01F 6/18; D01F 6/38; D01F 9/00; D01F 9/08; D01F 9/12; D01F 9/14; D01F 9/32; D01F 9/324; D01F 9/326; D01F 9/328; D01F 11/00; D01F 11/02; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D06M 15/643; D06M 2101/40; D06M 15/53; D01D 5/096
See application file for complete search history.

(56) References Cited

U.S. PATENT DOCUMENTS

| | | | | |
|---|---|---|---|---|
| 5,057,341 | A | 10/1991 | Ogiso et al. | |
| 5,571,442 | A | 11/1996 | Masaki et al. | |
| 6,103,211 | A | 8/2000 | Matsuhisa et al. | |
| 2008/0152574 | A1 | 6/2008 | Tanaka et al. | |
| 2010/0247911 | A1 | 9/2010 | Aso et al. | |
| 2013/0338281 | A1 | 12/2013 | Aso | |
| 2016/0376151 | A1* | 12/2016 | Nakayama | C01B 32/05 423/447.2 |
| 2019/0194829 | A1* | 6/2019 | Kajiwara | D01F 9/225 |
| 2019/0226124 | A1* | 7/2019 | Okuda | B01D 39/2065 |

FOREIGN PATENT DOCUMENTS

| | | | | |
|---|---|---|---|---|
| CN | 101849063 | A | 9/2010 | |
| CN | 103502519 | A | 1/2014 | |
| CN | 104611787 | A | 5/2015 | |
| EP | 0 340 475 | A2 | 11/1989 | |
| JP | 08-209543 | A | 8/1996 | |
| JP | 2001-172880 | * | 6/2001 | D06M 15/65 |
| JP | 2001-172880 | A | 6/2001 | |
| JP | 2002-370695 | * | 12/2002 | B64C 1/00 |
| JP | 2002-370695 | A | 12/2002 | |
| JP | 2002-371477 | A | 12/2002 | |
| JP | 2003-253567 | A | 9/2003 | |
| JP | 2006-183159 | A | 7/2006 | |
| JP | 2006-336181 | * | 12/2006 | D06M 15/643 |
| JP | 2006-336181 | A | 12/2006 | |
| JP | 2008-196097 | A | 8/2008 | |
| JP | 2009-215661 | A | 9/2009 | |
| JP | 2011-106045 | A | 6/2011 | |
| JP | 2012-046855 | A | 3/2012 | |
| JP | 2012-102429 | A | 5/2012 | |
| JP | 2014-163008 | A | 9/2014 | |
| JP | 2015-030931 | A | 2/2015 | |
| JP | 2016-166428 | A | 9/2016 | |
| JP | 2018-159138 | A | 10/2018 | |
| WO | 97/45576 | A1 | 12/1997 | |
| WO | 2018/003347 | A1 | 1/2018 | |

OTHER PUBLICATIONS

JIS K-5600, accessed online at https://industrialphysics.com/standards/jis-k-5600/ on Sep. 29, 2024 (Year: 2024).*
Written Opinion of the International Searching Authority for PCT/JP2020/032321 mailed Oct. 27, 2020 (Year: 2020).*
International Search Report for PCT/JP2020/032321, dated Oct. 27, 2020.

* cited by examiner

*Primary Examiner* — Daniel C. McCracken
(74) *Attorney, Agent, or Firm* — Sughrue Mion, PLLC

(57) ABSTRACT

The present invention provides a method for producing a carbon fiber bundle, the method including steps (b) to (e) described below:

(b) an oil agent application step of applying a silicone oil agent to a precursor fiber bundle to produce an oil-agent-attached precursor fiber bundle;

(d) a stabilization step of subjecting the oil-agent-attached precursor fiber bundle to an oxidization treatment to produce an oxidized fiber bundle; and (e) a carbonization step of carbonizing the oxidized fiber bundle, wherein the silicone oil agent has a skin over time at 250° C. of less than 40 minutes.

7 Claims, No Drawings

METHOD FOR PRODUCING CARBON FIBER BUNDLE

CROSS REFERENCE TO RELATED APPLICATIONS

This application is a National Stage of International Application No. PCT/JP2020/032321 filed Aug. 27, 2020, claiming priority based on Japanese Patent Application No. 2019-159139 filed Aug. 30, 2019.

TECHNICAL FIELD

The present invention relates to a method for producing a carbon fiber bundle. In particular, the present invention relates to a method for producing a carbon fiber bundle, the method including a step of subjecting a precursor fiber bundle for carbon fiber to a oxidization treatment by a predetermined method.

BACKGROUND ART

Carbon fibers have excellent specific strength and specific elastic modulus. By taking advantage of their lightweight properties and excellent mechanical properties, carbon fibers are widely industrially used as, for example, reinforcing fibers to be combined with a resin in aerospace applications, sports applications, general industrial applications, and the like.

As a method for producing carbon fibers, a method is generally employed in which a precursor fiber bundle is heated in an oxidizing atmosphere at 200 to 300° C. to be converted into an oxidized fiber bundle, and then the oxidized fiber bundle is carbonized in an inert atmosphere. At the time of such heat treatment at high temperatures, coalescence may occur between monofilaments of the precursor fiber bundle. Moreover, there is a problem that abrasion may occur during these steps due to friction between the fibers and between the fibers and the production apparatus to deteriorate the quality and grade of the obtained carbon fibers.

Therefore, the precursor fiber bundle has an oil agent applied thereto in the stabilization step. This is for the purpose of preventing coalescence between monofilaments due to a large amount of heat generation associated with the heat treatment or oxidation reaction, and of preventing damage due to abrasion during the step. A silicone oil agent is often used as the oil agent. Unfortunately, when a silicone oil agent is used, part of the silicone is thermally decomposed in the stabilization step and generate fine dust of silicon oxide or the like. Since the fine dust volatilizes into the stabilization furnace and contaminates the stabilization furnace, it is necessary to frequently clean the stabilization furnace, and thus the productivity is remarkably lowered. Moreover, if the fine dust contaminates the fiber bundle, the carbon fiber bundle is decreased in strength. Furthermore, the silicone oil agent applied to the fiber bundle may inhibit the spreading properties of the fiber bundle, or the gelled silicone oil agent may attach to a process roller or a guide in the stabilization step or the carbonization step, and the precursor fibers or the oxidized fibers may be wound on the process roller or the guide. This may result in a process failure, leading to a decrease in operability and a decrease in strength of the obtained carbon fibers. In addition, the silicone oil agent may penetrate into the monofilaments of the precursor fiber bundle and form voids in the surface layer and the inside of the monofilaments, so that the obtained carbon fiber bundle may be rather decreased in strength.

Various attempts have been made to inhibit the decrease in operability and the decrease in strength of the carbon fiber bundle caused by the silicone oil agent while preventing damage due to coalescence and abrasion between the monofilaments. As a method for inhibiting the decrease in operability caused by the silicone oil agent, for example, Patent Literature 1 discloses use of a silicone oil agent that has a specific composition and is hardly gelled. Patent Literature 2 discloses use of a certain percentage of modified silicone oil agent that is easily gelled. In addition, Patent Literature 3 proposes a method for preventing a decrease in spreading properties of a fiber bundle by using an oil agent having low viscosity. However, such oil agent easily penetrates into the monofilaments of the precursor fibers, so that the obtained carbon fibers may have insufficient strength.

CITATION LIST

Patent Literatures

Patent Literature 1: JP 2018-159138 A
Patent Literature 2: JP 2015-30931 A
Patent Literature 3: JP 2012-46855 A

SUMMARY OF INVENTION

Technical Problems

An object of the present invention is to provide a method for producing a carbon fiber bundle, the method being capable of preventing damage due to coalescence and abrasion between monofilaments in a stabilization step and a carbonization step, and of producing a carbon fiber bundle having excellent physical properties.

Solution to Problems

The present inventors have found that the above-mentioned problems can be solved by applying, to a precursor fiber bundle, a silicone oil agent that is increased in molecular weight by predetermined heating, and then subjecting the precursor fiber bundle to an oxidization treatment during the stabilization step in the production of a carbon fiber bundle, and have completed the present invention.

The present invention that solves the above-mentioned problems is a production method described below.

[1] A method for producing a carbon fiber bundle, the method including steps (b) to (e) described below:

(b) an oil agent application step of applying a silicone oil agent to a precursor fiber bundle to produce an oil-agent-attached precursor fiber bundle;

(d) a stabilization step of subjecting the oil-agent-attached precursor fiber bundle to an oxidization treatment to produce an oxidized fiber bundle; and (e) a carbonization step of carbonizing the oxidized fiber bundle, wherein the silicone oil agent has a skin over time at 250° C. of less than 40 minutes.

The invention described in the item [1] is a method for producing carbon fibers, the method including applying a predetermined silicone oil agent to a precursor fiber bundle for carbon fiber, heating the oil-agent-attached precursor fiber bundle for carbon fiber to increase the molecular weight of the silicone, and then subjecting the oil-agent-attached precursor fiber bundle for carbon fiber to an oxidization treatment. The silicone oil agent used in this method has a skin over time at 250° C. of less than 40 minutes, and the silicone in the silicone oil agent is rapidly increased in molecular weight to come into a gelled state. The silicone increased in molecular weight is less likely to be thermally decomposed into silicon oxide in the stabilization step. In addition, the silicone brought into a gelled state due to the increase in the molecular weight hardly penetrates into the monofilaments of the precursor fibers.

[2] The method according to the item [1], further including, before the oil agent application step, (a) a preheating step of preheating the precursor fiber bundle at 200 to 250° C.

[3] The method according to the item [1] or [2], further including, after the oil agent application step and before the stabilization step, (c) a heating step of heating the oil-agent-attached precursor fiber bundle at 150 to 200° C.

[4] The method according to any one of the items [1] to [3], wherein the silicone oil agent is a silicone oil agent containing an amino-modified silicone having a reactive terminal.

[5] The method according to any one of the items [1] to [4], wherein the silicone oil agent is an oil-in-water emulsion.

[6] The method according to any one of the items [1] to [5], wherein the silicone oil agent contains a polyoxyalkylene alkyl ether containing a polyoxyalkylene including both an ethylene oxide unit and a propylene oxide unit, and an alkyl group, and the polyoxyalkylene alkyl ether has a ratio of number of ethylene oxide units/number of propylene oxide units of 2 to 20.

Advantageous Effects of Invention

According to the method for producing a carbon fiber bundle of the present invention, after the predetermined silicone oil agent is applied to the precursor fiber bundle, the silicone in the silicone oil agent is rapidly increased in molecular weight and the silicone oil agent is brought into a gelled state. Therefore, the method is capable of providing a carbon fiber bundle that hardly contaminates a stabilization furnace and has excellent physical properties while preventing damage due to coalescence and abrasion between monofilaments in the stabilization step and the carbonization step.

DESCRIPTION OF EMBODIMENTS

Hereinafter, the method for producing carbon fibers of the present invention will be described in detail.

In the present invention, the skin over time means the time that is determined by lightly touching with the fingertip the center of a surface to which the silicone oil agent is applied, and is the time until the fingertip is no longer soiled with the silicone oil agent (see JIS K 5600-1-1). Specifically, the skin over time is measured by a test method in the section of Examples described later. That is, 2.0 g of the silicone oil agent is weighed in a round aluminum cup having a bottom area of 12.6 $cm^2$, the aluminum cup is allowed to stand in an oven at 250° C., the sample is taken out every 5 minutes, and a stainless steel rod is brought into contact with and separated from the sample. The heating time at 250° C. required until the sample no longer attaches to the stainless steel rod is defined as the skin over time. In addition, the skin over time means the time required for the silicone oil agent to dry to the touch, and does not mean the actual drying time in the present invention.

The method for producing a carbon fiber bundle of the present invention includes steps (b) to (e) described below:

(b) an oil agent application step of applying a predetermined silicone oil agent to a precursor fiber bundle to produce an oil-agent-attached precursor fiber bundle;

(d) a stabilization step of subjecting the oil-agent-attached precursor fiber bundle to an oxidization treatment to produce an oxidized fiber bundle; and (e) a carbonization step of carbonizing the oxidized fiber bundle.

The method preferably includes, before the oil agent application step (b), (a) a preheating step of preheating the precursor fiber bundle at 200 to 250° C.

The method preferably includes, after the oil agent application step (b) and before the stabilization step (d), (c) a heating step of heating the oil-agent-attached precursor fibers at 150 to 200° C.

The oil agent application step (b) in the present invention is a step of applying the silicone oil agent to the precursor fiber bundle to produce the oil-agent-attached precursor fiber bundle. The attachment amount of the silicone oil agent to the precursor fibers is preferably 0.01 to 5.0 mass %, more preferably 0.05 to 1.5 mass %, and particularly preferably 0.1 to 0.5 mass %. In the present invention, the attachment amount of the silicone oil agent refers to the amount of the active ingredient of the silicone oil agent attached to the precursor fibers, and the active ingredient of the oil agent refers to the residue (solid content) (%) after the oil agent is heated at 105° C. for 3 hours. The attachment amount of the silicone oil agent can be changed by adjusting the silicone concentration in an oil agent bath or the viscosity of the oil agent bath. The attachment amount of the silicone oil agent can also be adjusted by adjusting, after the application of the silicone oil agent, the amount of squeezing out the excess silicone oil agent.

A method for applying the silicone oil agent to the precursor fiber bundle is not particularly limited, but known methods such as a dipping method, a roller immersion method, and a spraying method can be employed. Among them, the dipping method and the roller immersion method are preferably employed because the methods are capable of easily and uniformly applying the silicone oil agent. The liquid temperature of the silicone oil agent bath is preferably in the range of 10 to 50° C. in order to reduce a change in the concentration of the silicone oil agent due to evaporation of the solvent, and demulsification.

The amount of the active ingredient in the silicone oil agent bath is preferably 0.5 to 40 mass %, and more preferably 1.5 to 30 mass %. Usually, a silicone oil agent containing 5 to 70 mass % of an active ingredient is appropriately diluted with water for the adjustment of the silicone content.

The silicone oil agent used in the present invention is a silicone oil agent having a skin over time at 250° C. of less than 40 minutes. The skin over time at 250° C. is preferably 38 minutes or less. The silicone oil agent after set-to-touch drying is in a state in which the silicone is increased in molecular weight and is uniformly gelled, and the silicone oil agent hardly penetrates into the fiber bundle.

With use of the silicone oil agent having a skin over time at 250° C. of less than 40 minutes, the silicone in the silicone oil agent is crosslinked and rapidly gelled, so that excessive penetration of the silicone oil agent into the precursor fiber bundle can be inhibited. If the skin over time at 250° C. exceeds 40 minutes, the oil agent easily penetrates into the monofilaments of the precursor fibers, so that the obtained carbon fibers may be decreased in strength. Meanwhile, the skin over time is preferably more than 5 minutes. If the skin over time is 5 minutes or less, gelation of the silicone oil agent may be completed before moisture is sufficiently evaporated.

The silicone contained in the silicone oil agent used in the present invention is an organopolysiloxane, and may be a modified product, a branched product, a partially crosslinked product, a copolymer with other molecules, or the like of the organopolysiloxane. Specific examples of the silicone include dimethylsilicone, phenylmethylsilicone, methylhydrogensiloxane, an alkylaralkyl-modified silicone, a fluorine-modified silicone, an amino-modified silicone, an amino-modified polyether-modified silicone, an amide-modified silicone, and these silicones having a reactive terminal; and silicone wax, silicone resin, silicone resin oil, silicone elastomer, stearoxymethylpolysiloxane, and an aminomethyl aminopropyl siloxane-dimethylsiloxane copolymer. Among them, an amino-modified silicone, an amino-modified polyether-modified silicone, an amide-modified silicone, and these silicones having a reactive terminal are preferred, and an amino-modified silicone having a reactive terminal is particularly preferred. Examples of such a silicone oil agent include silicone oil agents disclosed in JP 2002-129016 A and JP 2005-298689 A.

The form of the silicone oil agent is not particularly limited, but it is preferred to use water as a solvent from the viewpoint of handleability, and it is preferred that the silicone oil agent be an oil-in-water emulsion. The surfactant used for forming an emulsion is preferably a surfactant that has high dilution stability in a silicone oil agent bath and can rapidly demulsify the oil agent after the oil agent is attached to fibers. Although the surfactant is not particularly limited, the silicone oil agent preferably contains a nonionic surfactant. The nonionic surfactant is preferably a polyoxyalkylene alkyl ether. The polyoxyalkylene alkyl ether is preferably an ether compound containing a polyoxyalkylene including an ethylene oxide unit and/or a propylene oxide unit as a repeating unit, and an alkyl group, and is particularly preferably an ether compound containing a polyoxyalkylene including both an ethylene oxide unit and a propylene oxide unit, and an alkyl group. The number of carbon atoms in the alkyl chain of the polyoxyalkylene alkyl ether is preferably 5 to 15, and more preferably 10 to 15. The number of ethylene oxide units of the polyoxyalkylene alkyl ether is preferably 1 to 100, more preferably 1 to 50, and still more preferably 1 to 20. The number of propylene oxide units of the polyoxyalkylene alkyl ether is preferably 1 to 100, more preferably 1 to 50, and particularly preferably 1 to 20. The ratio of number of ethylene oxide units/number of propylene oxide units is preferably 1 to 50, and more preferably 2 to 20. Use of such a polyoxyalkylene alkyl ether as a surfactant can provide a silicone oil agent having a skin over time of less than 40 minutes.

The content of the surfactant may be appropriately adjusted according to the content of the silicone and the like, but is usually 1 to 50 parts by mass, and more preferably 5 to 40 parts by mass with respect to 100 parts by mass of the silicone.

The method for producing the emulsion is not particularly limited, and a known method can be employed. Examples of the method include the method disclosed in JP 2002-129016 A (in particular, paragraphs 0028 to 0034 and 0041).

As for the precursor fiber bundle used in the production method of the present invention, various precursor fiber bundles of polyacrylonitrile, pitch, rayon (cellulose), and the like can be used. A polyacrylonitrile fiber bundle capable of easily providing desired carbon fibers having high strength can be suitably used. The polyacrylonitrile fiber bundle can be produced by spinning a spinning solution obtained by homo- or copolymerizing monomers containing acrylonitrile preferably in an amount of 90 mass % or more, and more preferably in an amount of 95 mass % or more and containing 10 mass % or less of other monomers. Examples of other monomers include itaconic acid and (meth)acrylic acid esters. The raw material fibers after spinning are washed with water, dried, and drawn to provide precursor fibers.

The number of filaments of the precursor fiber bundle used in the present invention is preferably 1,000 to 100,000, and more preferably 3,000 to 50,000. From the viewpoint of production efficiency, the number of filaments is preferably 12,000 or more, and more preferably 24,000 or more. In addition, the number of filaments per unit width is preferably 5,000 filaments/mm or less, and more preferably 3,000 filaments/mm or less. If the number of filaments per unit width exceeds 5,000 filaments/mm, the attachment amount of the silicone oil agent tends to vary largely.

The stabilization step (d) in the present invention is a stabilization step of subjecting the oil-agent-attached precursor fiber bundle to which the silicone oil agent is attached to an oxidization treatment to produce an oxidized fiber bundle. In the present invention, the silicone in the silicone oil agent is crosslinked to be increased in molecular weight (gelled) by at least the heat treatment in the stabilization step. Since the silicone in the silicone oil agent is rapidly gelled, it is possible to inhibit excessive penetration of the silicone oil agent into the precursor fibers and to provide carbon fibers having high strength. In the present invention, it is preferred that the oil-agent-attached precursor fiber bundle be subjected to the heat treatment before the stabilization step. It is more preferred to provide an independent heat treatment furnace after the application of the silicone oil agent and before the stabilization step, and perform the heat treatment by a heating step (c) of heating the oil-agent-attached precursor fiber bundle at 150 to 200° C.

The heating time at 150 to 200° C. is preferably 10 to 1,000 seconds, more preferably 50 to 200 seconds, and still more preferably 100 to 200 seconds. In the present invention, although the skin over time of the used silicone oil agent is defined, it is not always necessary to perform the heat treatment until the silicone oil agent dries to the touch.

It is also preferred to provide a preheating step (a) of preheating the precursor fiber bundle at 200 to 250° C. before the application of the oil agent, and apply the silicone oil agent to the preheated precursor fiber bundle. Preheating of the precursor fiber bundle before the application of the oil agent can further inhibit the penetration of the silicone oil agent into the monofilaments of the precursor fibers, and can reduce voids present on the surface of the monofilaments of the precursor fibers, so that it is possible to provide carbon fibers having higher strength. In the present invention, the treatment time in the preheating step is preferably 10 to 1,000 seconds, and more preferably 100 to 300 seconds. In the present invention, the preheating treatment is preferably performed until the treated precursor fibers have a water vapor adsorption amount (at a humidity of 90%) of 10 cc/g or less from the viewpoint of the strength of the obtained carbon fibers. It is more preferred that the preheating treatment be performed until the treated precursor fibers have a water vapor adsorption amount of 5 to 8.5 cc/g. The water vapor adsorption amount at a humidity of 90% indicates the state of pores on the surface of the precursor fibers. The smaller the water vapor adsorption amount is, the smaller the number of voids on the surface of the monofilaments of the precursor fibers is.

The preheating step (a) and the heating step (c) may be used in combination. Alternatively, it is also possible to perform, of the stabilization step performed in multiple stages, the heat treatment in a stabilization furnace in the first stage at a set temperature of 150 to 200° C. without providing the independent heat treatment furnace after the application of the silicone oil agent.

The stabilization can be performed under known conditions. For example, when PAN fibers are used as the precursor fibers, the precursor fibers are subjected to an oxidization treatment at 200 to 260° C. in the heated air at a draw ratio in the range of 0.85 to 1.15 for 10 to 100 minutes. The oxidization treatment causes the fibers to undergo a cyclization reaction to provide oxidized fibers having an increased oxygen bond amount. In the oxidization treatment, the treatment temperature may be gradually increased by the application of a temperature gradient.

According to the production method of the present invention, the silicone oil agent is rapidly gelled because it is heated after being applied. That is, since the stabilization step is performed after the silicone is increased in molecular weight, thermal decomposition of the silicone into silicon oxide in the stabilization step can be inhibited. As a result, the volatilization of silicon oxide in the stabilization furnace is inhibited. In addition, since the silicone oil agent is rapidly gelled, it is possible to keep the silicone oil agent on the surface of the monofilaments to inhibit the silicone oil agent from penetrating into the monofilaments. In addition, uneven attachment of the oil agent on the surface of the monofilaments is inhibited, and the oil agent is easily homogeneously applied. As a result, it is possible to inhibit breakage of the monofilaments due to abrasion or the like during the stabilization step.

The carbonization step (e) in the present invention is a carbonization step of heating the oxidized fiber bundle to 300° C. or more in an inert atmosphere to carbonize the oxidized fiber bundle. Conventionally known carbonization conditions can be employed. For example, a method of performing a first carbonization treatment at 300 to 800° C. in a nitrogen atmosphere, and then performing second carbonization at 800 to 1600° C. can be mentioned. When a higher elastic modulus is required, a graphitization treatment may be performed at 2000 to 3000° C.

According to the production method of the present invention described above, breakage of single yarns is inhibited, and the Fuzz to be described later can be set to 40 μg/m or less. As a result, it is possible to produce a high tensile strength carbon fiber bundle, which preferably has a tensile strength of an epoxy resin-impregnated strand of 6,000 MPa or more in accordance with JIS R-7608.

Examples

Hereinafter, the present invention will be described more specifically with reference to examples, but the present invention is not limited to the examples. Components and test methods used in the examples and comparative examples will be described below.

[Dry to Touch Test]

In an aluminum cup having a bottom area of 12.6 $cm^2$, 2.0 g of a silicone oil agent is weighed, the aluminum cup is allowed to stand in an oven at 250° C., the sample is taken out every 5 minutes, and a stainless steel rod is brought into contact with and separated from the sample. The heating time at 250° C. required until the sample no longer attaches to the stainless steel rod is defined as the skin over time.

[OCU (Oil Agent Attachment Amount)]

The oil agent attachment amount was determined by extracting an oil agent from an oil-agent-attached precursor fiber bundle by a Soxhlet extraction method using a mixed liquid of ethanol and benzene as a solvent, then drying the solution containing the oil agent, and weighing the resulting solid content.

The oil-agent-attached precursor fiber bundle was dried at 70° C. for 1 hour, and about 5 g of the oil-agent-attached precursor fiber bundle was weighed (the mass of the fiber bundle then is defined as $M_1$). In accordance with the Soxhlet extraction method and using the mixed liquid of ethanol and benzene (1:2 in volume ratio) as a solvent, the liquid was refluxed for 4 hours to extract the oil agent attached to the oil-agent-attached precursor fiber bundle with the solvent. After the extraction, the precursor fiber bundle was removed, the solvent was concentrated, and the extract was transferred to a weighing bottle (the tare is defined as $M_2$) and dried at 105° C. for 2.5 hours. Then, the amount of the extract ($M_3$) was measured, and the oil agent attachment amount was determined by the following formula.

$$\text{Oil agent attachment amount } [M \text{ (mass \%)}] = (M_3 - M_2)/M_1 \times 100$$

[Number of Abrasion Cycles Until Oxidized Fiber Bundle is Broken]

An oxidized fiber bundle was cut into a length of 1.0 m. Three stainless steel needles (diameter: 2 mm) were arranged at intervals of 2 cm so that the carbon fiber bundle might pass over the surfaces of the stainless steel needles while being in contact with the stainless steel needles at a contact angle of 135°. The cut carbon fiber bundle was passed between the stainless steel needles in a zigzag manner, and while a tension of 1.0 g/Tex was applied to the oxidized fiber bundle, a reciprocating motion was performed over a width of 3 cm until the fiber bundle was broken by the abrasion (number of reciprocating abrasion cycles: 200 times/min). The number of reciprocations until the fiber bundle was broken was counted. The abrasion resistance of the oxidized fiber bundle was evaluated on the following three scales by the number of reciprocations until the fiber bundle was broken.

○: more than 2,500 times

Δ: 1,500 to 2,500 times x: less than 1,500 times

[Number of Broken Single Yarns of Carbonized Fibers]

A carbonized fiber bundle was cut into a length of 1.0 m and spread, and the number of broken monofilaments (number of broken single yarns) was visually counted.

The state of occurrence of broken single yarns of the carbonized fibers was evaluated on the following three scales.

○: less than 100 count/m

Δ: 100 to 200 count/m x: more than 200 count/m

[Water Vapor Adsorption Amount of Precursor Fibers]

The state of pores on the fiber surface of the precursor fiber bundle before the oil agent treatment was evaluated according to the water vapor adsorption amount. As for the water vapor adsorption amount of the precursor fiber bundle, a precursor fiber bundle cut into a length of about 15 cm (about 0.3 g) was subjected to the measurement under the following conditions using a fully automatic gas adsorption analyzer "AUTOSORB-1" manufactured by Yuasa Ionics Co., Ltd. The value of the water vapor adsorption amount at a humidity of 90% is a value obtained at a point where the relative pressure (P/Po) is 0.9.

Adsorption gas: $H_2O$

Dead volume: He

Adsorption temperature: 293 K

Measurement range: relative pressure (P/Po)=0 to 1.0

P: measurement pressure

Po: saturated vapor pressure of $H_2O$

[Carbon Fiber Strength]

The tensile strength of an epoxy resin-impregnated strand was measured in accordance with JIS R-7608, and the average of 5 times of measurement is shown.

[Fuzz]

Five chromium-plated stainless steel rods (diameter: 2 mm) were arranged at intervals of 15 mm in a zigzag manner so that a carbon fiber bundle might pass over the surfaces of the stainless steel rods while being in contact with the stainless steel rods at a contact angle of 120°. A carbon fiber bundle was passed between the stainless steel rods in a zigzag manner, and subjected to abrasion between the stainless steel rods.

The carbon fiber bundle after the abrasion was sandwiched between two urethane sponges (base area: 32 mm×64 mm, height: 10 mm, weight: about 0.25 g), a 125 g weight was placed so that a load might be applied to the entire surface of the urethane sponges, and the carbon fiber bundle was passed at a speed of 15 m/min for 2 minutes. The weight of fuzz attached to the sponges then was taken as the amount of abrasion fuzz.

(Production of Precursor Fiber Bundle)

In an aqueous zinc chloride solution, an acrylonitrile copolymer composed of 95 mass % of acrylonitrile, 4 mass % of methyl acrylate, and 1 mass % of itaconic acid was dissolved at a concentration of 7 mass % to prepare a spinning dope. The spinning dope was discharged into a 25 mass % aqueous zinc chloride solution (coagulation liquid) through a spinneret to continuously produce a coagulated fiber bundle. The coagulated fiber bundle was washed with water and drawn, subjected to oil application, dried and densified, and then subjected to post drawing to produce a precursor fiber bundle having a monofilament fineness of 0.7 dtex and a number of filaments of 24,000.

(Production of Silicone Oil Agent)

Silicone Oil Agent A:

Into a homogenizer, 15 mass % of an amino-modified silicone oil having a kinematic viscosity of 1000 $mm^2/s$ and an amine number of 0.3, 3 mass % of polyoxypropylene polyoxyethylene tridecyl ether (the number of carbon atoms in the alkyl chain, the number of ethylene oxide units, and the number of propylene oxide units are shown in Table 1) as a surfactant, and 82 mass % of ion-exchanged water were added and stirred to prepare an O/W emulsion, thereby obtaining a silicone oil agent A. The silicone oil agent A had a skin over time at 250° C. of 35 minutes.

Silicone Oil Agents B to G:

Each O/W emulsion was prepared in the same manner as for the silicone oil agent A except that the type of the surfactant was changed as shown in Table 1 to produce a silicone oil agent. The skin over times of the silicone oil agents at 250° C. are shown in Table 1.

TABLE 1

| | Number of carbon atoms in alkyl chain | Number of ethylene oxide units | Number of propylene oxide units | Ethylene oxide/propylene oxide | Skin over time [min] |
|---|---|---|---|---|---|
| Silicone oil agent A | 13 | 10 | 2 | 5 | 35 |
| Silicone oil agent B | 10 | 8 | 2 | 4 | 35 |
| Silicone oil agent C | 10 | 6 | 4 | 1.5 | 40 |
| Silicone oil agent D | 10 | 6 | 8 | 0.75 | 40 |
| Silicone oil agent E | 13 | 7 | 0 | — | 90 |
| Silicone oil agent F | 13 | 8 | 0 | — | 80 |
| Silicone oil agent G | 18 | 10 | 0 | — | 70 |

Example 1

The precursor fiber bundle was immersed in a silicone oil agent bath filled with a silicone oil agent solution (silicone oil agent A) containing the silicone oil at a concentration of 15 mass % to apply the oil agent to the precursor fiber bundle. Then, the precursor fiber bundle was heated at 150° C. for 180 seconds, and then subjected to an oxidization treatment at 240 to 250° C. for 1 hour while being drawn at a draw ratio of 1.0 to produce an oxidized fiber bundle. Subsequently, the oxidized fiber bundle was subjected to a carbonization treatment at 300 to 1200° C. in a nitrogen atmosphere to produce a carbonized fiber bundle. The resulting carbonized fiber bundle was subjected to a surface treatment using an aqueous ammonium sulfate solution as an electrolytic solution, a sizing agent (epoxy resin) was added and applied to the carbonized fiber bundle, and the carbonized fiber bundle was dried to produce a carbon fiber bundle.

The number of abrasion cycles until breakage of the obtained oxidized fiber bundle was counted, and the result showed that the number of abrasion cycles was more than 2,500.

The number of broken single yarns of the obtained carbonized fiber bundle was less than 100 count/m. The carbon fiber bundle had a strength of 6,200 MPa. The Fuzz was 33 μg/m.

Examples 2 to 4 and Comparative Examples 1 to 5

Each carbon fiber bundle was produced in the same manner as in Example 1 except that the type of the oil agent and the oil agent attachment amount were changed as shown in Table 2. The results are shown in Table 2.

In all of Examples 1 to 4 in which either of the silicone oil agents having a skin over time of 35 minutes was used, short fibers were less damaged in the stabilization step and the carbonization step, and high-quality carbon fibers having high strength were obtained.

Example 5

The precursor fiber bundle was preheated in the air at 220° C. for 180 seconds. Then, the preheated precursor fiber bundle was put in a silicone oil agent bath filled with a silicone oil agent solution (silicone oil agent A) containing the silicone oil at a concentration of 15 mass % to apply the oil agent to the precursor fiber bundle. The attachment amount of the oil agent was 0.4 mass % in terms of silicone. Then, the precursor fiber bundle was heated at 150° C. for 90 seconds. Then, the oil-agent-attached precursor fiber bundle was subjected to an oxidization treatment at 240 to 250° C. for 1 hour while being drawn to produce an oxidized fiber bundle. Subsequently, the oxidized fiber bundle was subjected to a carbonization treatment at 300 to 1200° C. in a nitrogen atmosphere to produce a carbon fiber bundle.

The number of abrasion cycles until breakage of the obtained oxidized fiber bundle was counted, and the result showed that the number of abrasion cycles was more than 2,500.

The number of broken single yarns of the obtained carbon fiber bundle was less than 100 count/m. The carbon fiber bundle had a strength of 6,150 MPa.

Examples 6 to 15

Each carbon fiber bundle was produced in the same manner as in Example 5 except that the preheating temperature, preheating time, and heat treatment temperature of the precursor fiber bundle, and the type of the oil agent were changed as shown in Table 3. The results are shown in Table 3.

Example 16

A carbon fiber bundle was produced in the same manner as in Example 5 except that the precursor fiber bundle was not preheated. The results are shown in Table 3.

TABLE 2

| | Type of oil agent | Number of carbon atoms in alkyl group | Number of ethylene oxide units | Number of propylene oxide units | Skin over time [min] | OCU [%] | Number of abrasion cycles until stabilized yarn is broken | Number of broken single yarns of carbon fiber yarns | CF strength [MPa] | Fuzz [μg/m] |
|---|---|---|---|---|---|---|---|---|---|---|
| Example 1 | A | 13 | 10 | 2 | 35 | 0.4 | ○ | ○ | 6200 | 33 |
| Example 2 | B | 10 | 8 | 2 | 35 | 0.4 | ○ | ○ | 6100 | 39 |
| Example 3 | A | 13 | 10 | 2 | 35 | 0.2 | Δ | Δ | 6250 | 33 |
| Example 4 | B | 10 | 8 | 2 | 35 | 0.2 | Δ | Δ | 6150 | 39 |
| Comparative Example 1 | C | 10 | 6 | 4 | 40 | 0.4 | Δ | x | 5800 | 46 |
| Comparative Example 2 | D | 10 | 6 | 8 | 40 | 0.2 | x | x | 5850 | 46 |
| Comparative Example 3 | E | 13 | 7 | 0 | 90 | 0.4 | x | x | 5700 | 46 |
| Comparative Example 4 | F | 13 | 8 | 0 | 80 | 0.4 | Δ | x | 5700 | 66 |
| Comparative Example 5 | G | 18 | 10 | 0 | 70 | 0.4 | Δ | x | 5700 | 98 |

TABLE 3

| | Type of oil agent | Heat treatment temperature [° C.] | Heat treatment time [sec] | Water vapor adsorption amount [cc/g] | Oil agent treatment temperature [° C.] | OCU [%] | Number of abrasion cycles until stabilized yarn is broken | Number of broken single yarns of carbon fiber yarns | CF strength [MPa] |
|---|---|---|---|---|---|---|---|---|---|
| Example 5 | A | 220 | 180 | 8.0 | 150 | 0.4 | ○ | ○ | 6150 |
| Example 6 | A | 220 | 180 | 8.0 | 180 | 0.4 | ○ | ○ | 6200 |
| Example 7 | A | 220 | 180 | 8.0 | 200 | 0.4 | Δ | ○ | 6200 |
| Example 8 | B | 200 | 180 | 8.6 | 150 | 0.4 | ○ | ○ | 6050 |
| Example 9 | B | 200 | 180 | 8.6 | 180 | 0.4 | ○ | ○ | 6100 |
| Example 10 | B | 200 | 180 | 8.6 | 200 | 0.4 | Δ | ○ | 6100 |
| Example 11 | A | 250 | 180 | 7.7 | 180 | 0.4 | ○ | ○ | 6200 |
| Example 12 | A | 250 | 180 | 7.7 | 200 | 0.4 | Δ | ○ | 6200 |
| Example 13 | B | 250 | 180 | 7.7 | 180 | 0.4 | ○ | Δ | 6100 |
| Example 14 | B | 250 | 180 | 7.7 | 200 | 0.4 | Δ | Δ | 6100 |
| Example 15 | A | 180 | 180 | 8.8 | 180 | 0.4 | ○ | Δ | 6050 |
| Example 16 | A | 25 | 180 | 32.1 | 180 | 0.4 | Δ | Δ | 6050 |

The invention claimed is:

1. A method for producing a carbon fiber bundle, the method comprising steps (b), (d), and (e) described below:

(b) an oil agent application step of applying a silicone oil agent to a precursor fiber bundle to produce an oil-agent-attached precursor fiber bundle;

(d) a stabilization step of subjecting the oil-agent-attached precursor fiber bundle to an oxidization treatment to produce an oxidized fiber bundle; and (e) a carbonization step of carbonizing the oxidized fiber bundle, wherein the silicone oil agent has a skin over time at 250° C. of less than 40 minutes.

2. The method according to claim 1, further comprising, before the oil agent application step, (a) a preheating step of preheating the precursor fiber bundle at 200 to 250° C.

3. The method according to claim 1, further comprising, after the oil agent application step and before the stabilization step, (c) a heating step of heating the oil-agent-attached precursor fiber bundle at 150 to 200° C.

4. The method according to claim 1, wherein the silicone oil agent is a silicone oil agent containing an amino-modified silicone having a reactive terminal.

5. The method according to claim 1, wherein the silicone oil agent is an oil-in-water emulsion.

6. The method according to claim 1, wherein the silicone oil agent contains a polyoxyalkylene alkyl ether containing a polyoxyalkylene including both an ethylene oxide unit and a propylene oxide unit, and an alkyl group, and the polyoxyalkylene alkyl ether has a ratio of number of ethylene oxide units/number of propylene oxide units of 2 to 20.

7. The method according to claim 2, further comprising, after the oil agent application step and before the stabilization step, (c) a heating step of heating the oil-agent-attached precursor fiber bundle at 150 to 200° C.

* * * * *